US009057572B2

(12) United States Patent
Matteson

(10) Patent No.: US 9,057,572 B2
(45) Date of Patent: Jun. 16, 2015

(54) FIREARM EXTRACTION SYSTEM

(71) Applicant: RA BRANDS, L.L.C., Madison, NC (US)

(72) Inventor: David O. Matteson, Horse Cave, KY (US)

(73) Assignee: RA Brands, L.L.C., Madison, NC (US)

( * ) Notice: Subject to any disclaimer, the term of this patent is extended or adjusted under 35 U.S.C. 154(b) by 133 days.

(21) Appl. No.: 13/837,450

(22) Filed: Mar. 15, 2013

(65) Prior Publication Data

US 2014/0259843 A1 Sep. 18, 2014

(51) Int. Cl.
*F41A 15/00* (2006.01)
*F41A 15/14* (2006.01)

(52) U.S. Cl.
CPC ..... *F41A 15/14* (2013.01)

(58) Field of Classification Search
CPC ..... F41A 15/14; F41A 15/12
USPC ..... 42/25, 16, 69.02, 46
See application file for complete search history.

(56) References Cited

U.S. PATENT DOCUMENTS

| | | | |
|---|---|---|---|
| 3,397,473 | A | 8/1968 | Browning |
| 3,742,638 | A | 7/1973 | Archer |
| 4,265,043 | A | 5/1981 | Rowlands |
| 5,768,815 | A | 6/1998 | Casull |
| 5,979,331 | A | 11/1999 | Casull |
| 6,000,161 | A | 12/1999 | Aalto |
| 6,044,748 | A | 4/2000 | Westrom |
| 6,182,389 | B1 | 2/2001 | Lewis |
| 6,484,430 | B1 | 11/2002 | Robinson et al. |
| 6,536,150 | B2 | 3/2003 | Schweikart |
| 6,604,314 | B2 | 8/2003 | Fluhr |
| 6,609,319 | B1 | 8/2003 | Olson |
| 6,966,137 | B2 | 11/2005 | Gussalli Beretta |

(Continued)

FOREIGN PATENT DOCUMENTS

| | | | |
|---|---|---|---|
| DE | 371662 | C | 3/1923 |
| DE | 2 207 554 | A1 | 8/1973 |

(Continued)

OTHER PUBLICATIONS

International Search Report dated Jul. 3, 2014 for International Application No. PCT/US2014/024651 filed Mar. 12, 2014.

(Continued)

*Primary Examiner* — J. Woodrow Eldred
(74) *Attorney, Agent, or Firm* — Womble Carlyle Sandridge & Rice, LLP

(57) ABSTRACT

An extraction system for extracting a cartridge from a firing chamber of a firearm includes an extractor mounted within the firearm bolt which has a bolt head with a plurality of lugs proximate a bolt face, a cartridge recess extending axially inward from the bolt face, and an extractor aperture extending radially outward through one of the lugs. A spring aperture extends axially through the one lug and intersects with the extractor aperture. The extractor is slidably mounted within the extractor aperture and has a hook portion for coupling with the cartridge and a transverse spring bore extending through a mid-section of the extractor. The extraction system further includes an extractor spring having an anchor portion mounted about the outer surface of the bolt and a cantilever spring portion inserted through the spring aperture and into the transverse hole in the extractor, for resiliently biasing the extractor toward the cartridge recess.

21 Claims, 7 Drawing Sheets

(56) References Cited

U.S. PATENT DOCUMENTS

| | | | | |
|---|---|---|---|---|
| 7,395,626 | B2 | 7/2008 | Zedrosser | |
| 7,478,494 | B2 | 1/2009 | Zeh | |
| 7,627,974 | B2 | 12/2009 | Olson | |
| 7,735,410 | B2 | 6/2010 | Clark | |
| 8,069,600 | B2 | 12/2011 | Rousseau et al. | |
| 8,096,074 | B2 | 1/2012 | Robinson et al. | |
| 8,826,576 | B2 * | 9/2014 | Lewis | 42/25 |
| 2008/0092733 | A1 | 4/2008 | Leitner-Wise et al. | |
| 2011/0005383 | A1 | 1/2011 | Kramer | |
| 2014/0224114 | A1 * | 8/2014 | Faxon | 89/193 |

FOREIGN PATENT DOCUMENTS

| | | | |
|---|---|---|---|
| DE | 102005006677 | B3 | 7/2006 |
| EP | 2078915 | | 7/2009 |

OTHER PUBLICATIONS

Written Opinion dated Jul. 3, 2014 for International Application No. PCT/US2014/024651 filed Mar. 12, 2014.

"LMT O-Ring", http://www.mcssl.com/store/center-mass/catalog/product/37cbf23c122b4aeba55a6d322bd701ea (accessed Feb. 27, 2013).

"Extractor Spring Insert for AR15 / M16", http://www.windhamweaponry.com/shopexd.asp?id=140 (accessed Mar. 5, 2013).

"Ultimate Extractor Upgrade", http://sixsigmaarms.com/products.php?d=3 (accessed Mar. 7, 2013).

The MGI D-Fender D-Ring Brochure; 1 page; www.mgi-military.com; MG Industries; Bangor, Maine, Apr. 30, 2013.

MGI D-Fender Advertisements; 1 page; http://Google Images.com, Apr. 30, 2013.

Jeff Chudwin; D-Fender? Whats that? Does it really enhance extraction?; 1 page endorsement by Chief of Police, Olympia Fields P.D., Apr. 30, 2013.

"SLR 15 Rifle Specs—Extractor/Extraction System"; 3 pages; http://www.slrrifles.com, Dec. 2010.

"AR-15 Extractor Upgrade"; 1 page; Dillon Precision Products, Inc.; http://www.dillonprecision.com/content/p/9/pid/24687/catid/17/AR_15_Extractor_Upgrade, Dec. 2007.

* cited by examiner

FIREARM EXTRACTION SYSTEM

TECHNICAL FIELD

The present disclosure relates generally to firearms and, in particular, to extraction systems for removing a cartridge from the firing chamber of the firearm.

BACKGROUND

Actions for modern firearms generally are designed to operate within tight tolerances within a receiver of their firearm while providing both quick response and reliable operation over a high number of firing cycles. Such actions generally include a breech bolt with a number of locking lugs formed into the bolt head thereof. For example, in M16/AR15/M4 type firearms, the bolt head can include seven lugs arranged in an eight-lug spacing interval, with the space for the missing lug generally being occupied by a pivoting claw-type extractor device.

An eight-lug spacing interval has been found to be advantageous for rapid-fire, auto-loading firearms in that the amount of bolt rotation needed to lock the action is reduced when compared to bolts with breech configurations having fewer lugs. Such reduced amount of rotation can result in shorter firing cycles and quicker action operation. In the typical bolt configuration for an M16/AR 15 auto-loading rifle, the eighth lug is generally removed to allow sufficient space for a pivoting extractor device to be used, fitting within a slot machined along the outer surface of the bolt and pivotable through the gap created by the removal of the lug. However, in addition to reducing the bolt head to seven lugs for locking the bolt into the barrel extension, removing a lug and forming the gap that accommodates the extractor can affect the structural integrity of the bolt head, and can result in an unbalanced locking force. In addition, the extra manufacturing steps involved in machining the extractor slot and machining/manufacturing the pivoting claw-type extractor device adds expense to the firearm.

Accordingly, there exists a need for a simplified extraction system that is addresses the foregoing and other related and unrelated problems in the art.

SUMMARY

Generally described herein, the present disclosure relates to a simplified extraction system for removing a cartridge from the firing chamber of a firearm. The extraction system is mounted within the bolt head of the bolt of the firearm, the bolt head having a bolt face with a plurality of lugs formed about the bolt face and a cartridge recess extending axially inward from the bolt face. An extractor aperture will be formed along the bolt head extending radially outward through a selected one of the lugs, and a spring aperture will be extended axially through the selected lug and will intersect with the extractor aperture. The extraction system also includes an extractor that is slidably mounted within the extractor aperture and has a hook engaging portion for coupling with the cartridge. An extractor spring having an anchor portion received about the outer surface of the bolt and a cantilever spring portion inserted through the spring aperture and into a transverse hole in the extractor resiliently biases the extractor toward the cartridge recess and engagement with the cartridge therein.

The present disclosure also includes a bolt having an extractor configured for extracting a cartridge from a chamber of a firearm. The bolt includes a bolt head having a plurality of lugs proximate a bolt face, a cartridge recess extending axially inward from the bolt face, and an extractor aperture extending radially outward from the cartridge recess through a selected one of the plurality of lugs. The extractor is slidably mounted within the extractor aperture and is biased toward the cartridge recess, and includes a hook portion formed at its proximal end that projects into the cartridge recess and is configured to couple with a cartridge positioned within the cartridge recess. In addition, one or more ejectors can be received in the bolt and bolt head along an opposite side thereof from the extractor.

The techniques and structures employed to improve over the drawbacks of the prior devices and accomplish the advantages described herein will become apparent from the following detailed description of representative embodiments and the appended drawings and claims.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION OF REPRESENTATIVE EMBODIMENTS

It is to be understood that the invention of the present disclosure is not limited to the specific devices, methods, conditions, or parameters of the representative embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

As generally described, the present disclosure relates to an extraction system for removing a cartridge or cartridge case from the chamber of the firearm, shown here as an auto-loading rifle. It is to be appreciated, moreover, that applications of the extraction system are not limited to auto-loading rifles, and may include bolt action or lever action rifles and the like, auto-loading or pump action shotguns and the like, and other varieties of pistols and firearms. As described below, the extraction system of the present disclosure can provide several significant advantages and benefits over other extraction systems and methods for removing a cartridge from the chamber of the firearm. However, the recited advantages are not meant to be limiting in any way, as one skilled in the art will appreciate that other advantages may also be realized upon practicing the present disclosure.

Figure 1:
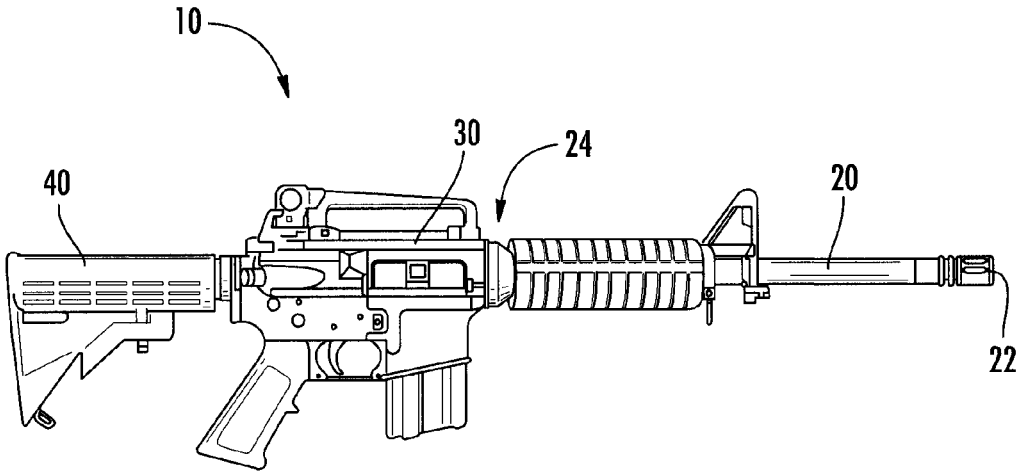
FIG. 1 is a side view of a representative firearm that has been configured to include the extraction system of the present disclosure.
Figure 2:
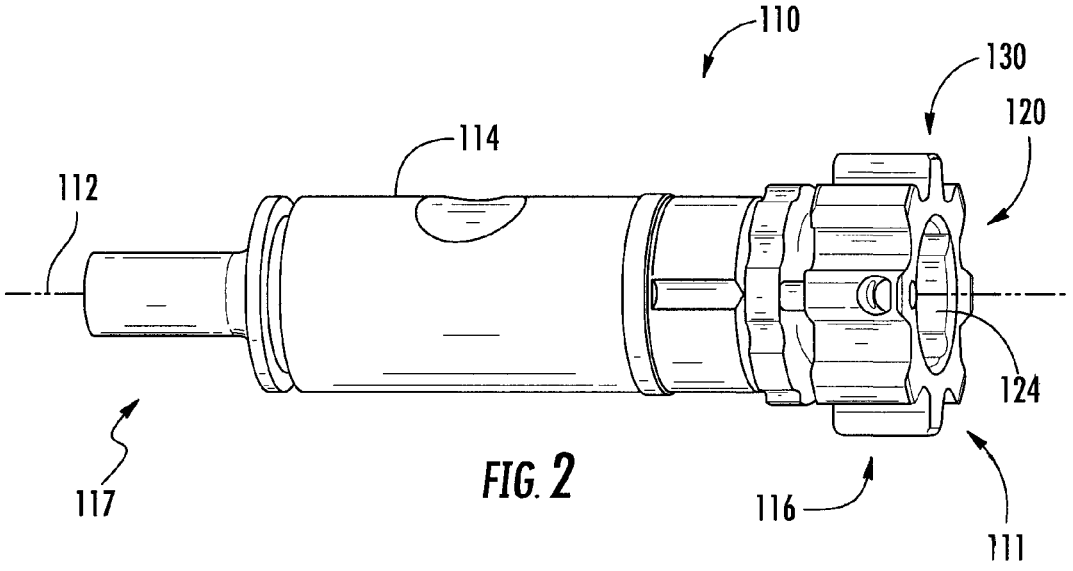
FIG. 2 is a perspective side view of a bolt that forms a portion of the extraction system, in accordance with a representative embodiment of the present disclosure.

FIG. 1 is a side view of a representative firearm that has been configured to include the extraction system of the present disclosure. In one example embodiment, the firearm can be an auto-loading, semi-automatic rifle 10, such as an AR-15, although the present invention further can be used in various other types of rifles, shotguns and other long guns, and other firearms. The firearm 10 of FIG. 1 includes a receiver 30 along which a breech bolt 110, as shown in FIG. 2, is received. The breech bolt includes a bolt head with a plurality of lugs 130 projecting radially therefrom to secure the bolt within a firing chamber 24 (FIG. 1) of the barrel 20. To close the firing chamber in preparation for firing, the bolt 110 (FIG. 2) is partially rotated so that the outwardly-extending lugs at the head end interconnect with complimentary lugs that extend inwardly from the back end of the barrel. This interconnection locks the bolt 110 into position and seals the firing chamber in preparation for firing, so that the projectile and substantially all the products of combustion are directed out the muzzle 22 (FIG. 1) of the barrel 20 while the recoil forces are transmitted backward through the stock 40 to the shoulder or body of the shooter.

Figure 3:
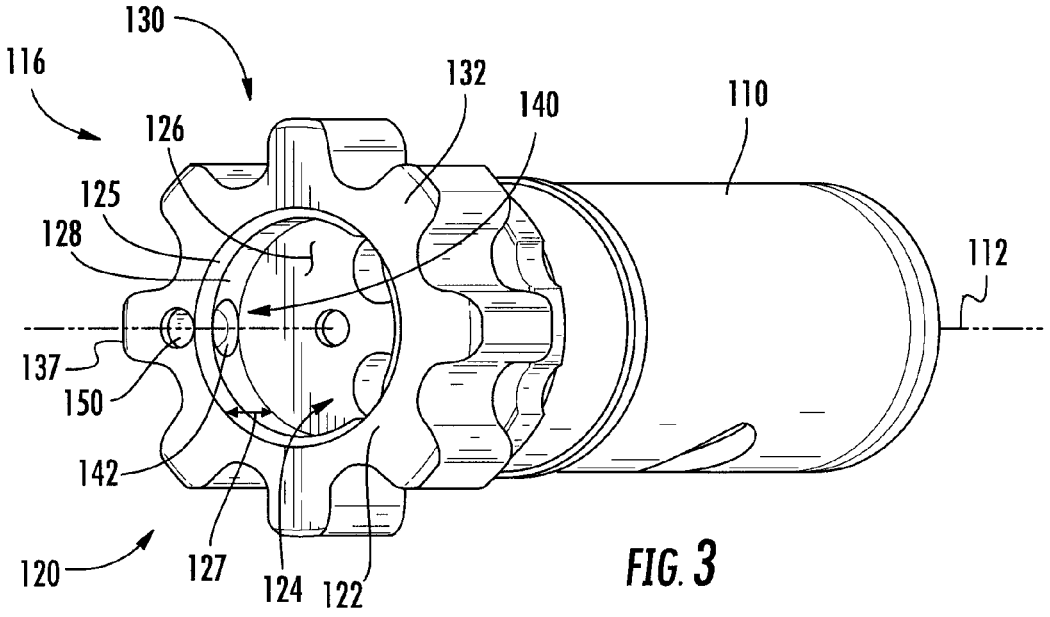
FIG. 3 is a perspective front view of the bolt of FIG. 2.

FIGS. 2-3 illustrate the bolt 110 in further detail, in accordance with a representative embodiment of the present disclosure. The bolt 110 has a centerline axis 112, an outer surface 114, a proximal end 117, with bolt head 116 formed or received at the distal end 111 opposite the proximal end 117. The bolt head 116 includes a bolt face 120 and is generally defined by the plurality of lugs 130 that projecting radially outward from the outer surface 114 of the bolt 110 proximate the bolt face 120. The bolt head 116 further includes a cartridge recess 124 that is centered about the centerline axis 112 and extends axially inward from the bolt face 120.

Figure 4:
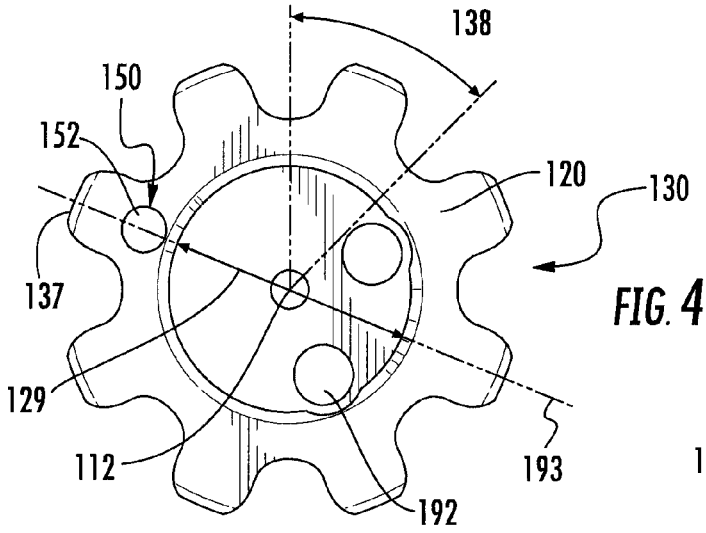
FIG. 4 is a front end view of the bolt of FIG. 2.
Figure 5:
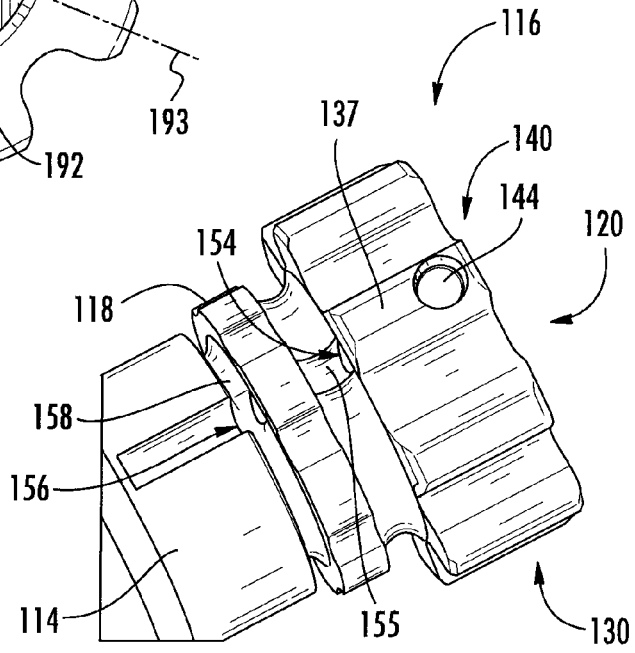
FIG. 5 is another perspective side view of the bolt of FIG. 2.

The bolt head 116 is shown in more detail in FIGS. 3-5. In the illustrated embodiment, the bolt head 116 can include eight symmetric lugs 130 that are equally-spaced around the circumference of the bolt 110 and separated from each other by gaps 136. With the eight-lug embodiment, each lug 130 has an arc-length 138 of about forty-five degrees, as measured between the radial centerlines of the gaps 136 (FIG. 4). The gaps 136 are sized and shaped so that the head end 116 of the bolt 110 can slide between complimentary lugs extending inwardly from the barrel (or barrel extension) as the bolt 110 moves toward the forward position closing the chamber, at which point the bolt 110 can be rotated about the centerline axis 112 for about twenty-two degrees until the lugs 130 of the bolt 110 align with the lugs of the barrel to lock the bolt 110 into its firing position.

As shown in FIG. 3, the bolt 110 can include a cartridge recess 124 that extends axially inward from the bolt face 120 a predetermined distance or depth 127. The cartridge recess is generally defined by cylindrical sidewalls 128 and has a cartridge bearing surface 126. The cartridge recess 124 typically has a diameter 129 that is sized to secure and center the base of a cartridge or cartridge case (not shown) of predetermined size/caliber as it is loaded in the chamber of the barrel, with the base and/or rim of the cartridge bearing against the cartridge bearing surface 126 of the bolt 110. In one aspect, the front edge of the cartridge recess can include a chamfered or beveled surface 125 that is configured to help capture and guide the back end of the cartridge into the cartridge recess 124.

The bolt face 120 of the bolt 110 or bolt head 116 can have an annular portion 122 that immediately surrounds the cartridge recess 124 and a plurality of lug face portions 132 forming the forward surfaces of the lugs 130. In the illustrated embodiment, the annular portion 122 and the lug face portions 132 together form a substantially smooth and planar bolt face 120 that can seat against a complimentary axial face that surrounds the opening to the firing chamber and can seal the firing chamber during firing.

The bolt head 116 further includes an extractor aperture 140 that extends radially through the center of the lug 137 selected from the plurality of lugs 130, from an inner opening 142 in the cylindrical sidewall 128 of the cartridge recess 124 clear through to a top opening 144 in the outermost radial surface of the selected lug 137. In the embodiment illustrated in FIGS. 3-5, the extractor aperture 140 can have a substantially constant diameter along its length, with the diameter of the extractor aperture 140 being less than the depth 127 of the cartridge recess 124 so that the inner opening 142 of the extractor aperture 140 is circumscribed by the cylindrical sidewall 128 of the cartridge recess 124.

The selected lug 137 that includes the extractor aperture 140 extending radially through the body of the lug can further include a spring aperture 150 that extends axially through the body of the lug and intersects with the extractor aperture 140. The spring aperture 150 can extend from a distal opening 152 in the lug face portion 132 clear through to a back opening 154 in the rearmost lug surface 134, as shown in FIG. 5. The spring aperture 150 can continue to extend axially rearward, as an axial groove and a second opening 156 through a rear stabilizing ring 118, to intersect with a circumferential groove 158 formed into the outer surface 114 of the bolt 110 and spaced from the lugs 130. As discussed below, the spring aperture 150 and circumferential groove 158 can be sized and shaped to receive the spring portion and the anchor portion, respectively, of an extractor spring.

The bolt 110 can further include provisions for an ejector mechanism that cooperates with the extraction system to extract and eject the cartridge from the firing chamber of the barrel. In the illustrated embodiment, the ejector mechanism can be a spring plunger-type ejector located in one or more ejector holes 192 extending axially from the cartridge bearing surface 126 of the cartridge recess 124. As shown, the ejector mechanism can be located substantially radially opposite the inner opening 142 of the extractor aperture 140, so as to provide the maximum leverage for rotating and ejecting the cartridge around the extraction system. With an ejector mechanism that utilizes two spring plunger-type ejectors, the holes 192 for the spring plungers can be symmetrically located on either side of the radial line 193 that intersects with both the extractor aperture 140 and the centerline axis 112 of the bolt 110, as illustrated in FIG. 4. However, other radial locations for the ejector mechanism within the cartridge recess 124 are also possible, as are other types of ejector mechanisms that may be combined with the extraction system described herein. Accordingly, the various alternative types of ejector mechanisms and their locations shall also be considered to fall within the scope of the present disclosure.

With reference to FIGS. 6-9, in one embodiment the extraction system 100 of the present disclosure includes a removable extractor 160 that can be slidably mounted with the extractor aperture. The extractor 160 can generally comprise a cylindrical body 162 having a first distal or outer end 168 received within the extractor aperture, and a second proximal or inner end 164 opposite the outer end 168 that projects inwardly through the inner opening in the sidewall of the cartridge recess. The extractor body 162 can further include a transverse spring aperture, hole or bore 166 that in one aspect can extend completely through the extractor body 162, as shown. In another aspect, however, the transverse hole can be a blind hole that only penetrates into the extractor body 162 from one side. The transverse hole 166 may be configured to align with the spring aperture 150 that extends axially through the body of the selected lug 137, as described above, with the spring aperture having a diameter that is generally larger than the diameter of the transverse hole 166. In one aspect, for instance, the spring aperture may have a diameter that is more than twice the diameter of the transverse hole 166.

The inner end 164 of the extractor 160 can further include features that allow the extractor 160 to engage the rim of the cartridge installed within the cartridge recess. These features can include a ramp portion 170, a hook portion 174 and an inner edge 172 located between the ramp portion 170 and the hook portion 174. The ramp portion 170 provides an angled bearing surface against which the base of the cartridge (not shown) can press to force the extractor 160 back into the extractor aperture and out of the way as the cartridge is being positioned within the cartridge recess. As the base of the cartridge nears the cartridge bearing surface, the rim of the cartridge will pass beyond the ramp 170 and inner edge 172 portions of the extractor 160 to align with the hook portion 174 on the opposite side of the extractor 160. This alignment allows the extractor 160 to spring back towards the centerline axis of the bolt, with the inner edge 172 of the extractor 160 sliding into an extractor groove located adjacent the rim of the cartridge, thereby capturing the rim of the cartridge and securing the cartridge into the cartridge recess.

Figure 6:
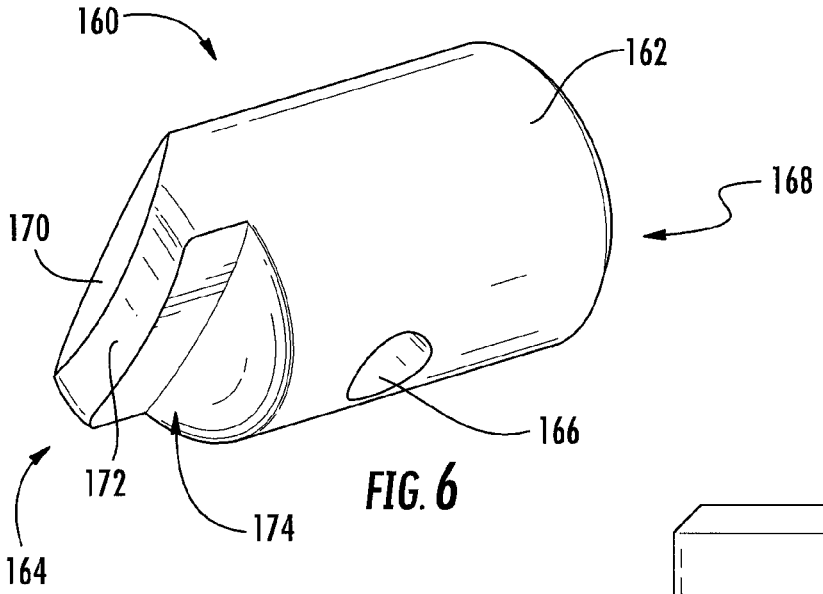
FIG. 6 is a perspective side view of an extractor that forms a portion of the extraction system, and that is configured for use with the bolt of FIG. 2.
Figure 7:
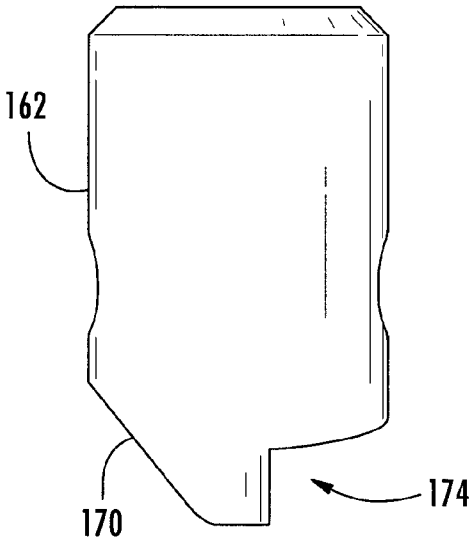
FIG. 7 is a first side view of the extractor of FIG. 6.
Figure 8:
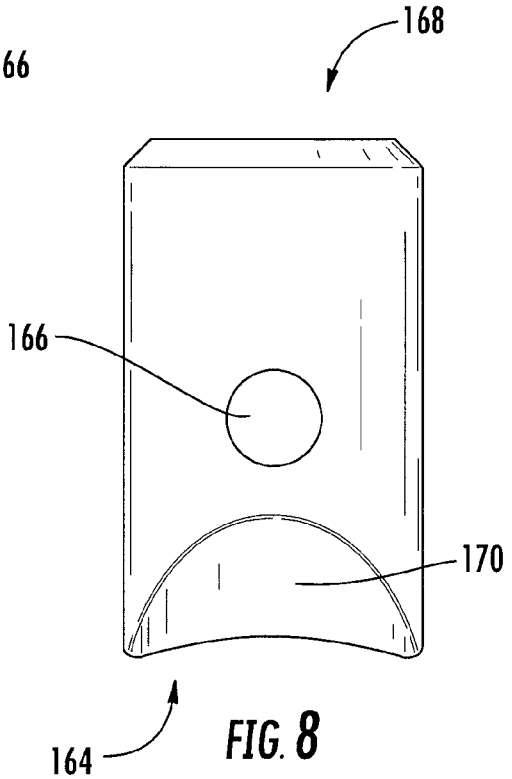
FIG. 8 is a second side view of the extractor of FIG. 6.

In one aspect of the disclosure illustrated in FIGS. 6 and 8, the axis of the transverse hole 166 through the extractor body 162 may be oriented perpendicular to the ramp 170, inner edge 172 and hook 174 portions formed into the inner end 164 of the extractor 160. As a result, aligning the transverse hole 166 with the spring aperture automatically serves to align the ramp portion 170, the inner edge 172 and the hook portion 174 in an orientation that is parallel with the bolt face and cartridge bearing surface of the bolt.

Figure 9:
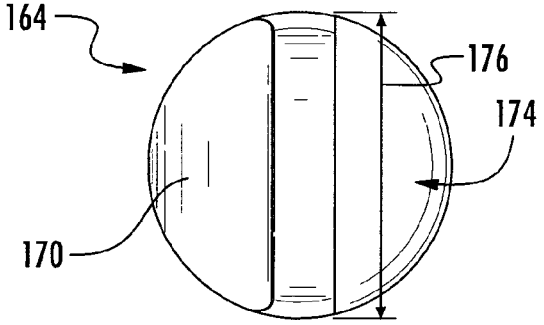
FIG. 9 is an end view of the extractor of FIG. 6.

In another aspect of the disclosure shown in FIG. 9, the hook portion 174 of the extractor 160 can have a width 176 that is equal to or slightly less than the diameter of the extractor, and thereby less than the depth 127 of the extractor recess 124 (FIG. 3) into which the inner end 164 of the extractor 160 is biased.

Figure 10:
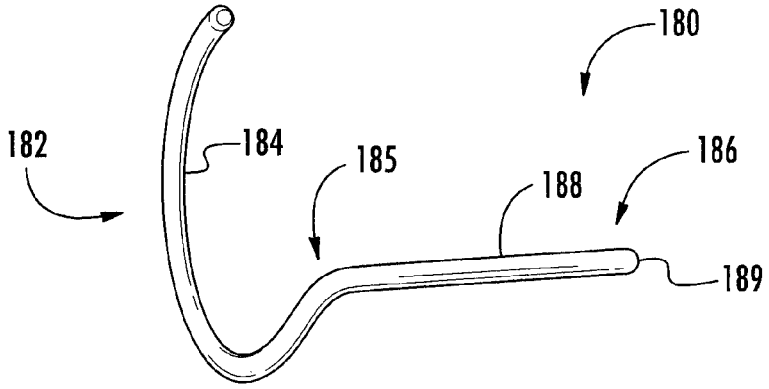
FIG. 10 is a perspective side view of an extractor spring that forms a portion of the extraction system, and that is configured for use with the bolt of FIG. 2.

Illustrated in FIG. 10 is a removable extractor spring 180 that includes an anchor portion 182 and a spring portion 186. In one aspect, the anchor portion 182 can comprise a loop 184 that mounts around the outer surface of the bolt. In embodiments of the bolt 110 having a circumferential groove 158 formed into the outer surface 114 (see FIG. 5) and spaced from the distal end 120 of the bolt head 116, the loop 184 or anchor portion 182 of the extractor spring 180 can be sized and shaped to be snuggly secured within the circumferential groove 158 once the extractor spring 180 is assembled onto the bolt 110. The spring portion 186 of the extractor spring 180 can comprise a cantilevered portion or bar 188 that may be installed through the spring aperture 150 in the bolt head 116, with the tip 189 of the cantilevered bar 188 being inserted into the transverse hole formed in the extractor.

The cantilevered bar 188 of the removable extractor spring 180 connects with the anchoring loop 184 at the flex corner 185. When the anchoring loop 184 is secured around the outer surface of the bolt 110, the cantilevered bar 188 is free to pivot, bend or flex about the flex corner 185, with the length of the cantilevered bar 188 providing a greater amount of motion at the tip 189 for the same amount of spring constant produced at the flex corner 185.

The assembled extraction system 100 is illustrated throughout the various views provided in FIGS. 11-14, wherein the extractor 160 is shown being slidably mounted within the extractor aperture 140 that is formed through the lug 137 selected from the plurality of eight lugs 130 forming the bolt head 116 of a typical AR-type firearm. In one aspect, the extractor 160 can be sized to fit entirely within the selected lug 137 and to be circumscribed/enclosed within the extractor aperture 140 formed through the selected lug 137, without removal of the lug or having to excise a substantial portion of the lug to mount the extraction system in the bolt, such that the selected lug 137 maintains the same size, shape and eight-lug spacing interval as each of the other lugs 130 forming the bolt head 116.

In providing an extractor 160 that can fit within just one of the eight equally-spaced bolt lugs 130 in the idealized locking configuration for AR-type firearm, the extraction system 100 of the present disclosure can circumvent the heretofore unresolved issue in AR-type firearms of having to remove one of the bolt lugs 130 to make room for an extractor mechanism. As such, the extraction system 100 can provide a breach bolt 110 that is both stronger and more dynamically balanced, and can provide a simpler and more reliable extraction system as compared with conventional pivoting claw-type extractor devices.

Figure 11:
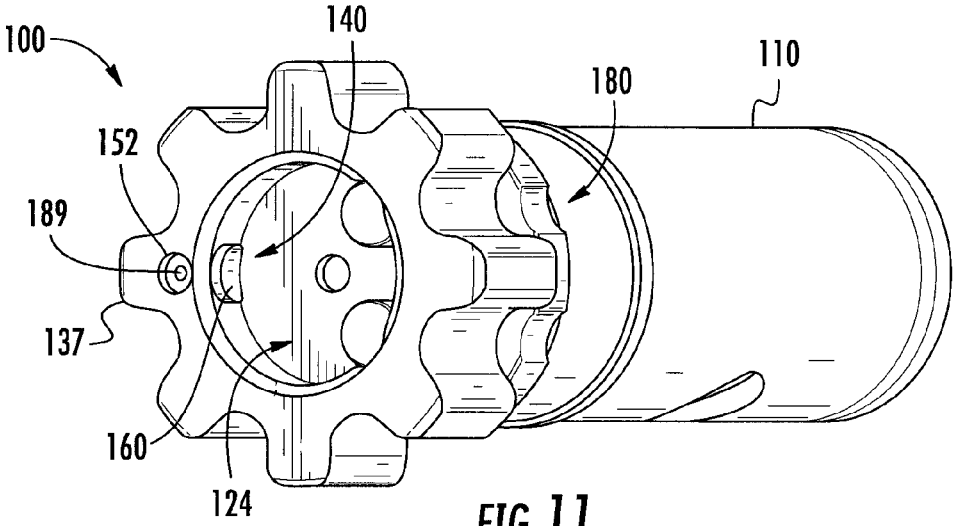
FIG. 11 is a perspective front view of the assembled extraction system, in accordance with the representative embodiment.
Figure 14:
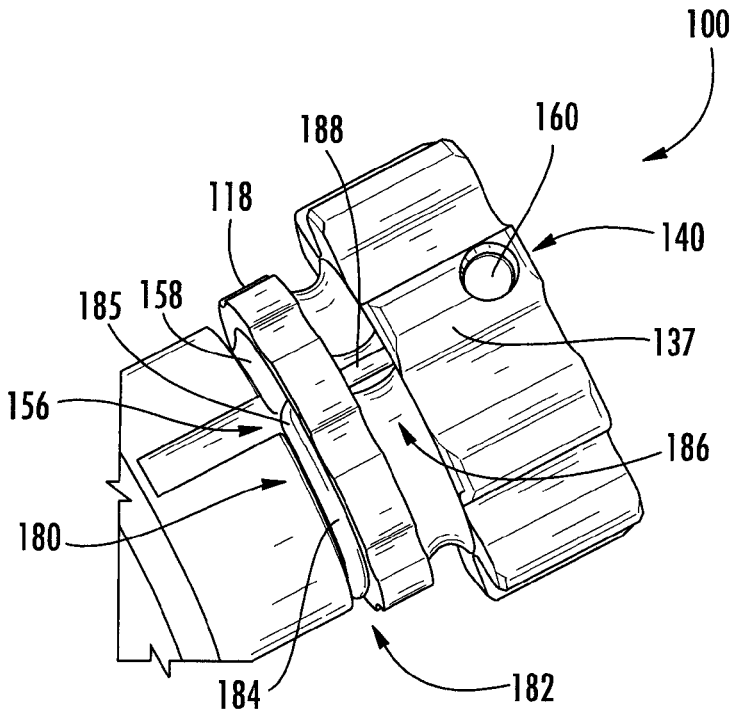
FIG. 14 is a second perspective side view of the assembled extraction system of FIG. 11.

As shown in FIG. 14, the extractor spring 180 can be assembled to the bolt 110 and to the extractor 160 by inserting the cantilever rod 188 forwardly through the spring aperture 150 that extends through both the rear stabilizing ring 118 and the selected lug 137, so that the tip 189 of the cantilever rod 188 passes through the aperture 156 in the rear stabilizing ring 118 and the back opening 154 (FIG. 5) in the selected lug 137 until the tip 189 contacts the extractor 160 and becomes engaged within the transverse hole in the extractor body. After the tip 189 of the cantilever rod 188 becomes connected with the extractor 160, the anchor portion 182 of the extractor spring 180 may be rotated until the loop 184 encounters the bolt and is snapped into position within the circumferential groove 158. This can operate to secure the anchor portion 182 of the spring extractor 180 to the bolt 110. In one aspect, the tip 189 of the installed extractor spring 180 may be visible through the distal opening 152 of the spring aperture 150, as illustrated in FIGS. 11 and 12.

In the embodiment of assembled extraction system 100 illustrated in FIGS. 11-14, the inside surfaces of the aperture 156 in the rear stabilizing ring 118 (FIG. 14) can provide a bearing or contact surface for the flex corner 185 of the extractor spring 180 to press against when flexed, so that the flex corner 185 can become the pivot point for the spring portion 186 of the extractor spring 180. In one aspect, the cantilever spring 180 may primarily bend or flex along the length of the cantilever rod 188 to provide a biasing force that directs the extractor 160 toward the cartridge recess 124 and centerline axis 112 of the bolt. In another aspect, the cantilever spring 180 may primarily bend or twist at the flex corner 185 to provide the biasing force. One factor for determining the location and type of flexing can include the ratio between the bendable length of the cantilever rod 188 (i.e. the distance between the flex corner 185 and the extractor 160) and the diameter and modulus of elasticity of the wireform material used to form the extractor spring 180. With all else being equal, a longer cantilever rod relative to a constant diameter and modulus of elasticity can allow for more flexing of the cantilever rod 188 than twisting at the flex corner 185.

Figure 12:
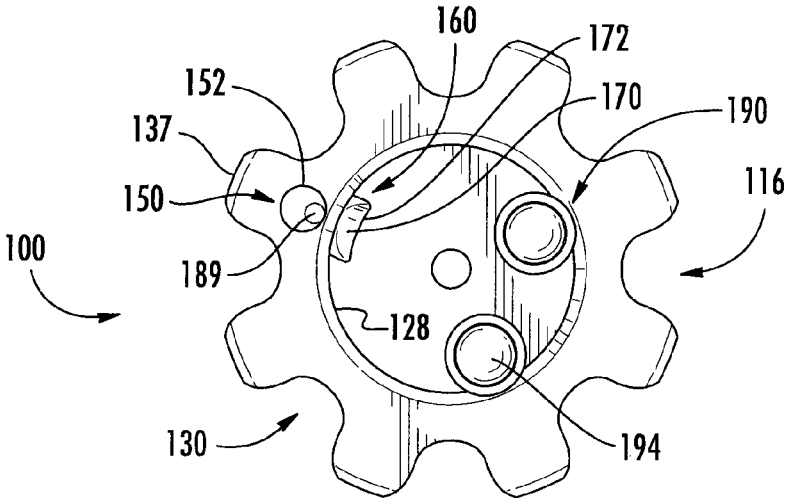
FIG. 12 is a front end view of the assembled extraction system of FIG. 11.
Figure 13:
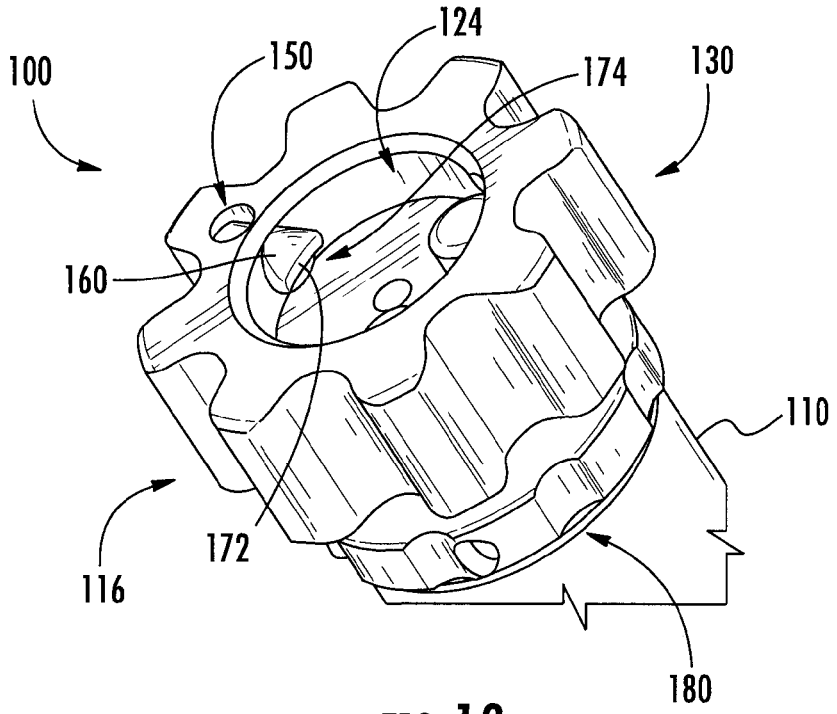
FIG. 13 is a first perspective side view of the assembled extraction system of FIG. 11.

In its normal unbiased and un-flexed position, the cantilever rod or portion 188 of the extractor spring 180 can be configured to position and orientate the slidable extractor 160 within the extractor aperture 140 so that the inner end 162 of the extractor 160 projects through the inner opening 142 and into cartridge recess 124, as shown in FIG. 12. In this position, the hook portion 174 will be urged or maintained in an alignment that is generally parallel to the cartridge recess of the bolt head. The ramp portion 170 of the extractor 160 further will be facing away from the cartridge recess 124 and will be the first surface to contact the base or rim of the cartridge when the cartridge is being positioned within the cartridge recess. As stated above, the ramp portion 170 provides an angled bearing surface against which the base or rim of the cartridge can press to force the extractor 160 back into the extractor aperture 150 and out of the way of the cartridge, thereby flexing the cantilever rod 188 or twisting the extractor spring 180 at the flex corner 185, or both. In either circumstance the extractor 160 is allowed to move radially outward into the extractor aperture 150, but with an increasing spring force that urges the extractor 160 back toward its original position.

The outward motion of the extractor 160 is made possible by the spring aperture 150 having a diameter that is larger than the diameters of both the transverse hole 166 and the cantilever rod 188, thereby allowing the cantilever rod 188 to move and flex within the spring aperture 150. The additional space provided by the difference in sizes between the diameter of the spring aperture 150 and the diameter of the cantilever rod 188 can be controlled to limit the radially outward motion of the extractor 160. In one aspect of the present disclosure, for instance, the diameter of the spring aperture 150 can be sized so that the extractor 160 moves radially outward just far enough for the inner edge 172 of the extractor 160 to become flush with the sidewall 128 of the cartridge recess 124. At this point the outer surface of the cantilever rod 188 can contact the inner wall of the spring aperture 150, limiting any further movement.

The radially outward motion of the extractor 160 with the extractor aperture 140 can continue until the rim of the cartridge passes beyond the ramp 170 and inner edge 172 portions of the extractor 160, thereby allowing the extractor spring 180 to push the extractor 160 back towards the centerline axis of the bolt until the inner edge 172 and hook portion 174 of the extractor 160 engage with the extractor groove and rim of the cartridge to capture and secure the cartridge with the cartridge recess.

Upon firing of the firearm, the extractor 160 continues to hold and secure the back end of the cartridge within the cartridge recess 124 as the bolt 110 rotates to unlock the lugs 130 and translates rearwardly to pull the cartridge out of the firing chamber, until the front end of the casing clears the chamber opening. At this point the one or more plunger ejectors 194 of the ejector system 190 can apply a pressure or force to the back surface of the cartridge that rotates the cartridge around the hook portion 174 of the extractor 160 and out an ejection port in the side of the receiver of the firearm. During the ejection cycle, the extractor spring 180 can operate to generally maintain the extractor 160 in its innermost position within the cartridge recess so that the hook portion 174 of the extractor 1650 can impart a substantially constant tension to the rim of the cartridge. After the ejection cycle is completed and the spent cartridge has been removed from the receiver of the firearm, the extractor spring 180 can continue to maintain the extractor 160 in its normal, innermost position so that the inner end 164 of the extractor 160 projects through inner opening 142 and into cartridge recess 124 in preparation for the next cartridge.

The extraction system 100 of the present disclosure can provide several significant advantages over other types of extraction systems currently available in the art, in addition to the elimination of the requirement to remove the eighth lug discussed above. For example, the general design of the removable extractor spring 180 can enable more consistent selection or tailoring of the spring force that is applied to extractor 160. By variation of the diameter of the wireform of the extractor spring 180, the material of the wireform, and the axial distance between the extractor aperture 140 formed through the selected lug 137 and the circumferential groove 158 formed into the outer surface 114 of the bolt 110, a desired amount of spring force can be to the extractor 160. In turn, the desired amount of spring force can translate into a desired ejection tension that is applied by the extractor 160 to the cartridge during the ejection cycle. In addition, the extractor spring 180 can apply the predetermined amount of spring force to the extractor 160 in a more consistent fashion and for an extended period of time because the material forming the extractor spring 180 can be operated more within its elastic limits than conventional coil springs.

In another aspect, the extraction system 100 of the present disclosure can be more cost effective to manufacture and assemble through the expanded use of basic manufacturing processes such as drilling, cutting and shaping. For example, both the extractor aperture 140 and the spring aperture 150 can be made by drilling into the selected lug 137 in the bolt head 116. Moreover, the extractor 160 itself may be simply and easily manufactured by cutting, drilling and then shaping one end of an appropriately-sized round bar stock. The extractor spring 180 can also be simply and easily manufactured through cutting and bending a wireform made from high strength spring steel.

Figure 15:
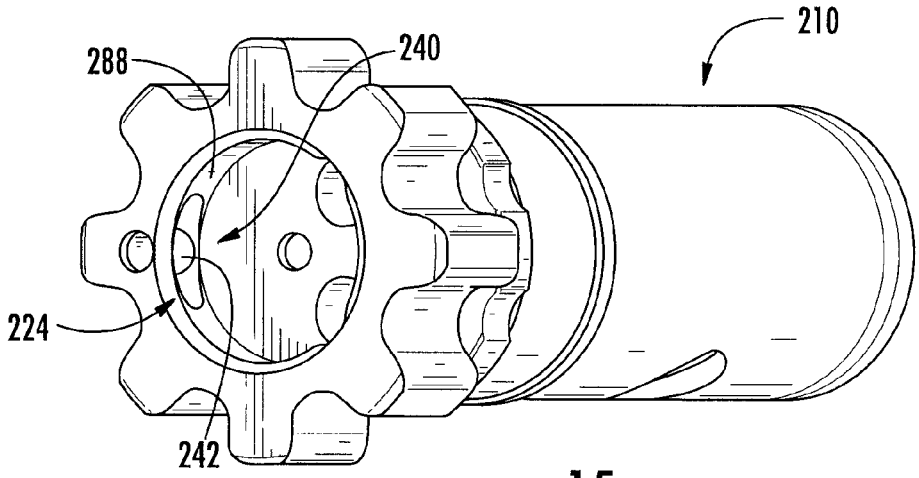
FIG. 15 is a perspective front view of a bolt that forms a portion of the extraction system, in accordance with a second representative embodiment.
Figure 16:
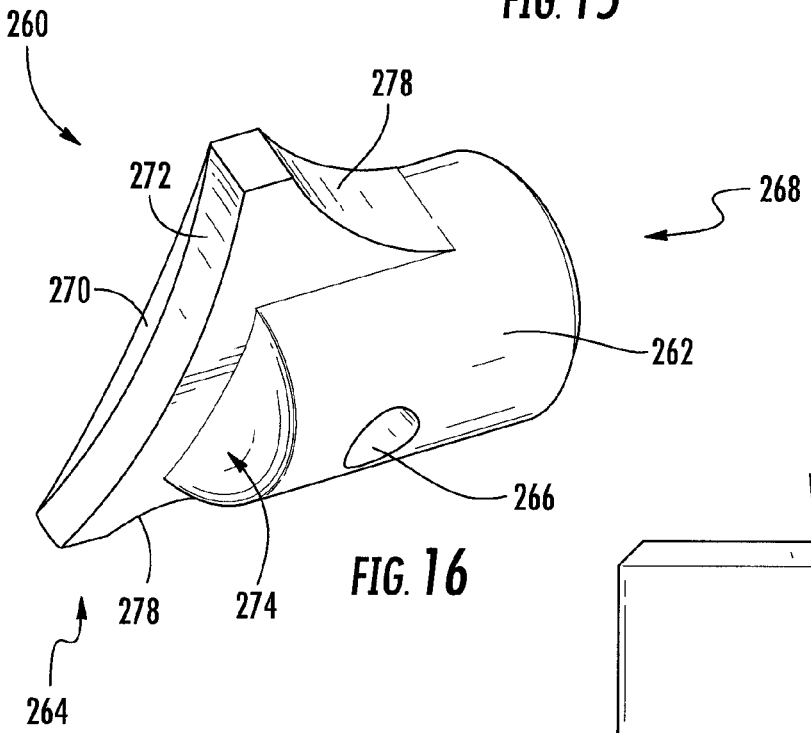
FIG. 16 is a perspective side view of an extractor that forms a portion of the extraction system, and that is configured for use with the bolt of FIG. 15.
Figure 17:
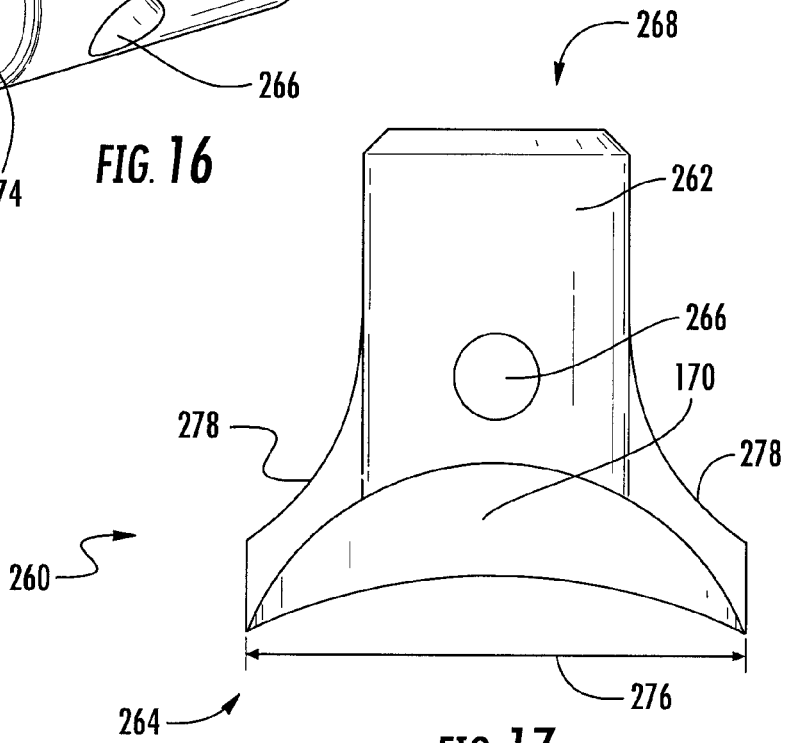
FIG. 17 is a side view of the extractor of FIG. 16.

Another embodiment 200 of the extraction system and extractor 260 is illustrated in FIGS. 15-19. In this embodiment, the extractor 260 has been modified to include an expanded or flared hook portion 274 and ramp portion 270 formed at the second proximal or inner end 264 of the extractor body 262, as shown in FIGS. 16-17. In one aspect, the extractor body 262 can be modified and shaped to include a pair of wing portions 278 that extend laterally from the sides of the extractor body 262 proximate the inner end 264. Other portions of the extractor 260 can remain unchanged, including the cylindrical shape proximate the first distal or outer end 268 of the extractor body 262 and the transverse hole 266 formed through the midsection. The wing portions 278 can serve to extend the width 276 of the hook portion 274, the ramp portion 270 and the inner edge 272 beyond the diameter of the cylindrical base of the extractor 260.

Figure 18:
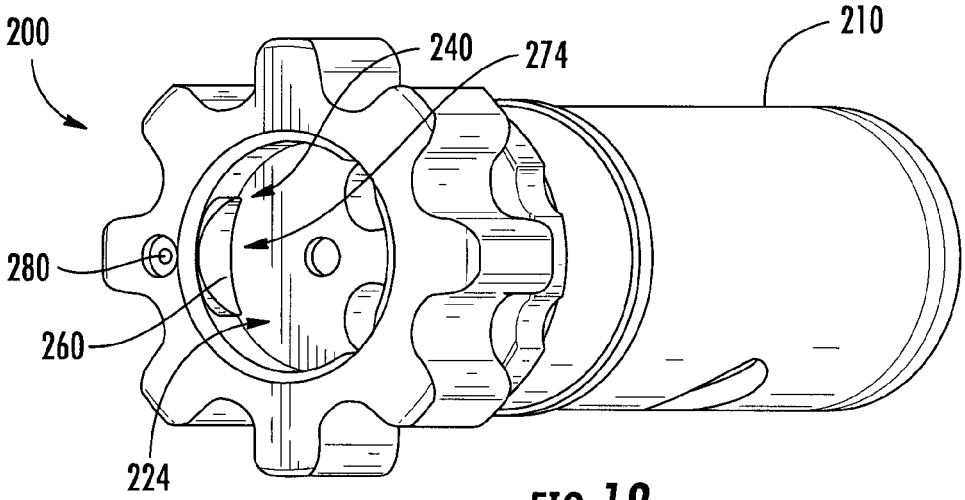
FIG. 18 is a perspective front view of the assembled extraction system, in accordance with the second representative embodiment.
Figure 19:
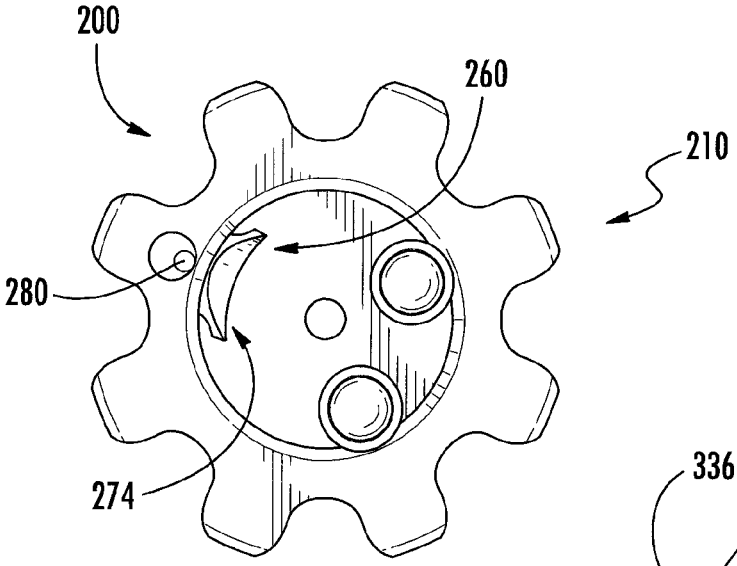
FIG. 19 is a front end view of the assembled extraction system of FIG. 18.

The firearm bolt 210 within which the extraction system 200 is used also may be modified in a corresponding manner, as shown in FIGS. 15 and 18-19, in that the inner opening 242 of the extractor aperture 240 formed into the sidewall 228 of the cartridge recess 224 can also be expanded to accommodate the pair of wing portions 278 extending from inner end 264 of the extractor 260 when the extractor is moved radially outward along and into the extractor aperture 240 by receipt of a cartridge in the cartridge recess of the bolt 210.

As with the previously-described embodiment, the extractor 260 is slidably movable with the extractor aperture 240 and is resiliently biased toward the cartridge recess 224 by the cantilevered rod 288 of the extractor spring 280, and which cantilevered rod 288 can be inserted into the transverse hole in the extractor body. In one aspect, the flared inner end of the extractor 260 includes the hook portion 274 having a width 276 that is greater than the depth of the cartridge recess 224. The wider hook portion 272 can assist in capturing and securing cartridges of a larger size within the cartridge recess, and can also help in distributing the extractor tension across a greater surface area of the rim of the cartridge during the ejection cycle.

Figure 20:
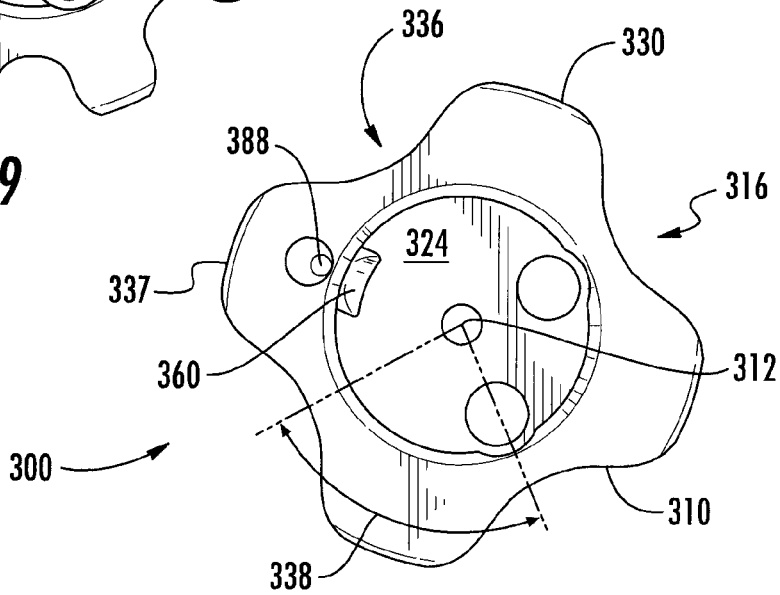
FIG. 20 is a front end view of the bolt of the extraction system, in accordance with yet another representative embodiment.

Another embodiment 300 of the extraction system is illustrated in FIG. 20. In this embodiment, the number of lugs extending from the bolt head 316 of the bolt 310 has been reduced to four lugs 330 that are substantially symmetric and equally-spaced around the circumference of the bolt 310 and separated from each other by gaps 336. With the four-lug embodiment, each lug 330 has an arc-length 338 of about ninety degrees, as measured between the radial centerlines of the gaps 336, with the bolt 310 being rotated about the centerline axis 312 for about forty-five degrees until the lugs 330 of the bolt 310 align with the lugs of the barrel to lock the bolt 310 into its firing position. As with the previously described embodiment, the extractor 360 can enclosed with an extractor aperture that extends radially through the center of one lug 337 selected from the plurality of lugs 330, from an inner opening in the cylindrical sidewall of the cartridge recess 324 clear through to a top opening in the outermost radial surface of the lug 337. The extractor 360 can also be biased toward the cartridge recess 324 by the cantilevered rod 388 of the extractor spring that can be inserted into the transverse hole formed into the extractor body.

Accordingly, it is to be appreciated that while the extraction system of the present disclosure has been described for use in an action of an M16/AR15 auto-loading rifle, the extraction system may also be suitable for integration into the fire control mechanisms and actions of other type of firearms.

The invention has been described in terms of preferred embodiments and methodologies considered by the inventors to represent the best mode of carrying out the invention. A wide variety of additions, deletions, and modification might well be made to the illustrated embodiments by skilled artisans without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed:

1. A firearm, comprising:

a receiver;

a barrel having a chamber configured to receive a cartridge; and a bolt movable within the receiver, the bolt comprising:

a bolt head having a bolt face with a plurality of lugs formed thereabout, and a cartridge recess axially inward from the bolt face, an extractor aperture spaced rearwardly from the bolt face, the extractor aperture formed through a side wall of the cartridge recess and a selected one of the plurality of lugs, and a spring aperture extending axially through the selected lug and intersecting with the extractor aperture;

an extractor slidably received within the extractor aperture, the extractor including a hook portion configured to couple with the cartridge received within the chamber; and an extractor spring extending along a cantilever spring portion that resiliently biases the extractor toward the cartridge recess to engage the hook portion with the cartridge.

2. The firearm of claim 1, further comprising a circumferential groove formed into an outer surface of the bolt and spaced from the plurality of lugs, and wherein the extractor spring includes an anchor portion at least partially disposed within the circumferential groove.

3. The firearm of claim 2, wherein the spring aperture intersects with the circumferential groove.

4. The firearm of claim 1, wherein the extractor comprises a substantially cylindrical shaped body having a first end received within the extractor recess, and a second end defining the hook portion and having a ramp portion extending rearwardly from the hook portion.

5. The firearm of claim 1, wherein the hook portion further comprises a flared hook portion, and the extractor aperture includes an expanded opening configured to at least partially receive the flared hook portion of the extractor.

6. The firearm of claim 5, wherein the flared hook portion includes a pair of wing portions projecting radially outwardly from a cylindrically-shaped extractor body.

7. The firearm of claim 1, wherein the plurality of lugs comprises at least four lugs, each of the lugs substantially equally spaced around the circumference of the bolt head and having an arc length of less than or about 90 degrees.

8. The firearm of claim 1, wherein the plurality of lugs comprises eight lugs substantially equally spaced around the circumference of the bolt head and having an arc length of less than or about 45 degrees.

9. The firearm of claim 1, wherein the bolt further comprises:

at least one ejector hole extending axially into the cartridge recess and located along the bolt head substantially opposite the extractor aperture; and at least one ejector slidably disposed within the at least one ejector hole.

10. The firearm of claim 9, wherein the firearm further comprises:

two ejector holes extending axially into the cartridge bearing surface substantially opposite the extractor aperture; and two ejector plungers, each installed into one of the two ejector holes.

11. A bolt for a firearm, the bolt comprising:

a bolt head having a bolt face, a plurality of lugs arranged in series proximate the bolt face, a cartridge recess extending axially inward from the bolt face and having a cartridge bearing surface spaced from the bolt face, and an extractor aperture formed within the bolt head and along the cartridge recess between the bolt face and the cartridge bearing surface, the extractor aperture extending radially outward from the cartridge recess through one of the plurality of lugs without removal of the lugs from the bolt head; and a reduced profile extractor enclosed and slidably mounted within the extractor aperture and the extractor having a hook portion configured to couple with a cartridge positioned within the cartridge recess, wherein the extractor is biased toward the cartridge recess such that its hook portion is urged into coupling engagement with a cartridge received within the cartridge recess.

12. The bolt of claim 11, wherein the extractor aperture is round and the extractor comprises a substantially cylindrically shaped body circumscribed by the extractor aperture and having the hook portion formed at a proximal end thereof.

13. The bolt of claim 11, further comprising:

a spring aperture extending axially through the one lug and intersecting with the extractor aperture; and an extractor spring having an anchor portion configured to engage an outer surface of the bolt, and a cantilever spring portion extending through the spring aperture and into the spring bore formed in the extractor, wherein the cantilever spring portion resiliently biases the extractor toward the cartridge recess.

14. The bolt of claim 13, further comprising a circumferential groove formed into an outer surface of the bolt and spaced from the plurality of lugs, and wherein the anchor portion of the extractor spring is at least partially disposed within the circumferential groove.

15. An extraction system for extracting a cartridge from a chamber of a firearm, the extraction system comprising:

an extractor aperture interiorly formed within and extending radially outward through a selected one of a plurality of lugs formed in radially spaced series about a bolt face of a firearm bolt, the extractor aperture defining a passage through a side wall of the selected one of the lugs spaced from the bolt face of a firearm bolt; and an extractor slidably mounted within extractor aperture and including a hook portion at a proximal end thereof configured to couple with a cartridge received within a cartridge recess of the bolt; and an extractor spring having an anchor portion installed about an outer surface of the bolt, and a cantilever spring portion extending axially through the selected lug and intersecting with the extractor;

wherein the cantilever spring portion resiliently biases the extractor in a radial direction toward a centerline axis of the bolt to couple the hook portion to the cartridge.

16. The extraction system of claim 15, wherein the extractor is circumscribed by and enclosed within the extractor aperture.

17. The extraction system of claim 15, wherein a width of the hook portion of the extractor is less than a depth of the cartridge recess.

18. The extraction system of claim 15, wherein the cantilever spring portion engages and urges the extractor toward an orientation whereby the hook portion of the extractor is aligned substantially parallel to the cartridge recess of the bolt.

19. The firearm of claim 1, wherein the extractor aperture extends radially through a center portion of the selected one of the plurality of lugs.

20. The bolt of claim 11, wherein the extractor aperture extends through a center portion of the selected one of the plurality of lugs.

21. The extraction system of claim 15, wherein the extractor aperture extends through a center portion of the selected one of the plurality of lugs.

* * * * *